United States Patent [19]

Case

[11] 4,093,816

[45] June 6, 1978

[54] FURNACE HEATING APPARATUS

[75] Inventor: Thomas L. Case, Toledo, Ohio

[73] Assignee: Midland-Ross Corporation, Cleveland, Ohio

[21] Appl. No.: 767,927

[22] Filed: Feb. 11, 1977

[51] Int. Cl.[2] ..... H05B 3/10; H05B 3/40

[52] U.S. Cl. ..... 13/2 R; 13/25; 126/91 A; 219/279

[58] Field of Search ..... 13/2–5, 13/25; 219/279; 126/91 A, 116 C

[56] References Cited

U.S. PATENT DOCUMENTS

| | | | |
|---|---|---|---|
| 2,843,107 | 7/1958 | Cirriani et al. | 126/91 A |
| 3,237,930 | 3/1966 | Hofmann | 13/2 |
| 3,521,986 | 7/1970 | Eckstrom | 126/91 A |

*Primary Examiner*—R. N. Envall, Jr.
*Attorney, Agent, or Firm*—Frank J. Nawalanic

[57] ABSTRACT

A radiantly heated furnace is provided with a heating arrangement capable of generating heat from two different sources of energy. The arrangement includes a thin-walled tube extending within the furnace which operates as a resistor when connected to a high current source of electrical energy to generate and radiate heat within the furnace. The thin-walled tube also acts to radiate heat into the furnace from hot burner gases injected therein by a fuel fired burner. The arrangement is so constructed that switching from the electric to the gas fire mode or vice versa can be swiftly effected without removal of electrical connections or burners.

8 Claims, 5 Drawing Figures

FURNACE HEATING APPARATUS

This invention relates to a heating arrangement for use in furnaces and the like and particularly to heating arrangements which radiate their heat to the desired work item.

This invention is particularly applicable to radiantly heated furnaces of a conventional type used in the heat treating field and will be described with particular reference thereto. However, it will be appreciated by those skilled in the art that the invention has broader scope and application and may in general be used where a source of heat radiating from a particular surface is desired.

Radiantly heated heat treat furnaces are generally characterized by a tube or series of tubes extending into the furnace enclosure. In some instances, heating elements are inserted in relatively small diameter tubes. When an electrical source of energy is applied to the heating elements, heat is generated within the tube thereby heating the tube which in turn radiates the heat to the work. The heating elements must be protected from direct exposure to the heat treating atmosphere to avoid breakdown thereof and thus the reason for their insertion in the tubes. In other instances, a burner is inserted at one end of a relatively large diameter tube and fires hot products of combustion through the tube which exit at the opposite end thereof. The hot products of combustion heat the tube which in turn radiate the heat to the work. It is necessary in many heat treating operations to avoid comingling of the products of combustion issuing from the burner with the furnace atmosphere and thus the reason for firing the products of combustion through a tube.

It is also known in the art to provide in a radiantly heated furnace a heating arrangement which comprises a length of small diameter tubing, bent in a preconfigured manner, and to which is applied an electric current. The tubing acts as a resistor to the current and becomes heated as the current travels therethrough. However, the current applied to such tubing is in the range of 1300–1400 amps and the tubing diameter is approximately 1–½ to 2 inches. Reference may be had to U.S. Pat. No. 3,259,527 for a more detailed description of such a heating arrangement.

All of the arrangements described utilize one source of energy, either electricity or a hydrocarbon fuel, to effect heating. Recently, there have been significant shortages of natural gas, propane and fuel oil which have led to the replacmement of many fuel fired tube arrangements with electrical heating arrangements. However, during the summer months electric shortages are becoming more frequent at a time when natural gas is available. This has resulted in physically changing the heat treat furnaces back to their fuel fired mode.

Changing the furnace from one heat mode to another is an extensive operation involving substantial changes to the furnace structure. Attempts have been made to simplify the changeover procedure with some degree of success. Changeover applications have been made by simply inserting conventional electric heating elements into gas fired tubes after removing the burner apparatus. Because gas fired tubes have to be larger in diameter than their electrical tube counterparts, a large air space between the heating element and tube exists and a larger mass of tubing must be heated by the heating element before the tube is sufficiently hot to radiate heat to the work in the furnace. More important than size considerations is the problem relating to heat transfer. Both conventional heating elements and the tube are made of alloyed steel. Fundamentally, heat transfer considerations, which take into account the tube size, require a temperature differential to obtain heat flow. Therefore, the heat output of a tube heated inside by an alloyed heating element is restricted by the safe working temperature of the inside alloyed heating element instead of the safe working temperature of the outside alloyed tube. This difference in working temperature can be substantial and decreases production capacity of furnaces so equipped with alloyed heating elements by as much as 50 percent.

To compensate for such an effect, the inventor has heretofore inserted solid graphite rods, which can be heated to a higher temperature than alloyed heating elements, into the fuel fired tubes after the burners have been removed. An inert gas atmosphere is then supplied to the tube when the graphitic elements are heated. While such an arrangement permits the furnace to be converted from one heating mode to another without changing the furnace structure (i.e., removing the tubes and replacing same with electrical heating elements), the procedure is still complex in that burners must be removed, heating elements inserted, and a source of inert gas must be supplied in a sealing manner to the tube to prevent oxidation of the graphite during heating. Also, while the graphitic heating elements can heat the furnace, the heat from the elements must be transferred to the tube and then radiated from the tube to the work and this additional heating step necessarily results in a time lag affecting furnace control which in turn requires a limit on the power input to the graphite element to avoid overheating of the furnace. This results in limiting or compromising the total heat input to the arrangement for start-up purposes.

It is thus an object of the subject invention to provide a heating arrangement which can be quickly changed from a fuel fired mode to an electrical heating mode and from an electrical heating mode to a fuel fired mode.

This object along with other features of the subject invention is achieved in a heating apparatus for a furnace enclosure which includes a thin-walled open-end tube extending into and out of the enclosure. An electrical power arrangement is attached to the ends of the tube for heating the enclosure by passing a high amperage current through the tube. Also attached to the open end of the tube is a combustion arrangement which permits heating of the enclosure by the passing of hot gases through the tube. A switching or interlock arrangement is provided for actuating the electrical power arrangement while deactivating the combustion arrangement without removing the combustion arrangement from the tube and, similarly, or actuating the combustion arrangement while deactivating the electrical power arrangement without removing the electrical power arrangement from the tube.

An inherent feature of this arrangement is that the current heats the tube directly which in turn radiates the heat to the work. This is more efficient and more responsive than known prior art arrangements which heated an electrical element which in turn had to heat the tube as described above.

Another feature of the subject invention is that the tubes employing the invention have a commercially acceptable life. That is, in view of the diameter of the tube which must be large to provide sufficient volumetric area for fuel firing, the wall thickness of the tube must be minimized to provide sufficient resistance to the high current which is about 3800 amps and no less than 3000 amps. In the fuel firing mode, the thickness of the wall tends to be reduced by the gas flow. More significant is a reduction in wall thickness brought about by the corrosive effects of the furnace atmosphere which alternately oxidize, reduce and/or carburize the outer wall. Uneven wall thickness may produce uneven voltage drops resulting in currents which promote "hot spots" in the thinner section. The hot spots interfere with the heat distribution to the work in the furnace, especially when considering the arrangement of several tube portions spaced closely adjacent one another and promote thermal fatigue of the metal which is accelerated when considering the deleterious corrosive effects of the furnace atmosphere.

Another feature assisting in the long life of the tube is the provision of at least a three point support for the tube to prevent distortion thereof. This distortion adversely affects heating of the furnace enclosure in both the gas fired and electrical heating modes.

Another object of the subject invention is to minimize inductive current losses by the use of "U" shaped or "W" or "Y" shaped tubes which have entrance and exit ends closely adjacent one another thereby permitting straight segment, busbar connections to be made from the electrical power source. The terminal connectors to the tubes and the busbars extend a minimal distance from the tubes to the transformer in the electrical power arrangement and are capable of resisting oxidation from the burners.

It is thus another object of the subject invention to provide a high current electric heating which is arranged in such a manner to minimize inductive current losses.

It is another object of the subject invention to provide a durable tubular heating arangement capable of being heated efficiently in either an electric or fuel fired mode.

It is still yet another object of the subject invention to provide an efficient and economical heating arrangement capable of being heated by two different sources of energy.

The invention may take form in certain parts and arrangement of parts, a preferred embodiment of which will be described in detail herein and illustrated in the accompanying drawings which form a part hereof and wherein.

Figure 1:
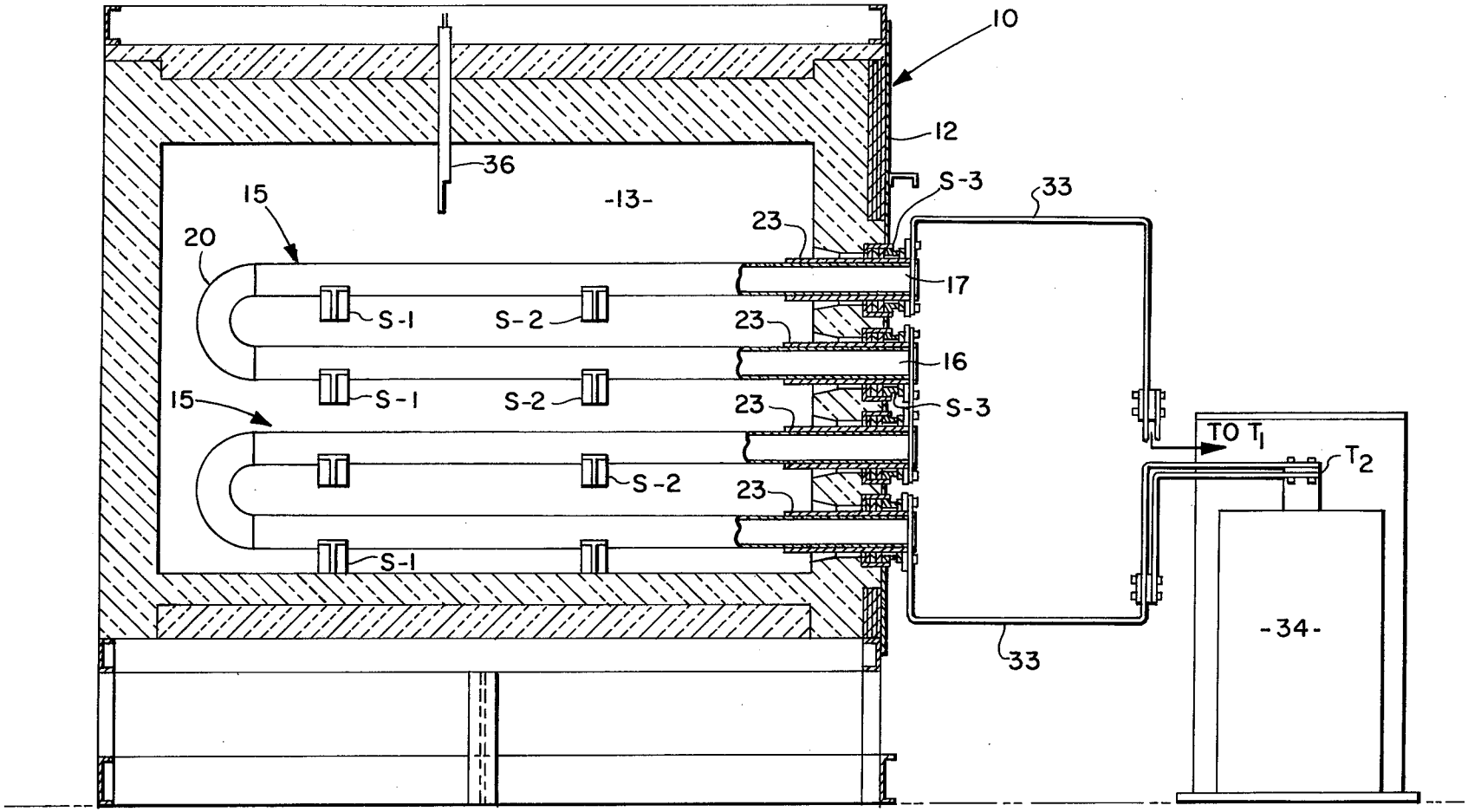
FIG. 1 is a section elevation view of a furnace taken along line 1-1 of FIG. 2 incorporating the subject invention but with the burners removed from the drawing for drawing clarity.

Referring now to the drawings wherein the showings are for purposes of illustrating a preferred embodiment of the invention only and not for the purpose of limiting same, there is shown in FIG. 1 a heat treat furnace 10 which is of conventional design and thus will not be described in significant detail herein. Furnace 10 comprises a roof, a floor and a plurality of walls which define an insulated furnace enclosure 13. The plurality of walls include a pair of sidewalls, a front end wall, and a rear end wall with only rear end wall numbered as 12.

Extending into and out of furnace enclosure 13 is a thin-walled open-end "radiant" tube 15. In the drawings, a U-shaped tube configuration is utilized and in the furnace shown, there are four U-shaped open-ended tubes 15, with two tubes positioned adjacent one sidewall and two tubes positioned adjacent the opposite sidewall. Other conventional designs such as "W" or "Y" configured tubes can be utilized. All such conventional fuel-fired configurations which utilize curved tube portions so that both ends of the tube are attached to a common furnace wall may be employed in the invention described. (Straight tubes which enter one way of the furnace and exit at an opposite wall are not deemed suitable for the present invention because of the resultant inductive current losses.) No matter what tube configuration is utilized, it is important that the wall thickness of the tube within furnace enclosure 13 be uniform throughout the tube. It is also important from the electrical heating mode that the wall thickness be maintained as thin as possible, nominally 0.120 inch (3.048 mm) and no greater than 0.125 inch (3.175 mm) and tolerances no greater than ±0.005 inch (±.127 mm). Also, no matter what tube configuration is utilized, the diameter of the tube must be sufficiently large to permit fuel firing which dictates that the tube must be at least 4 inches (10.6cm) in diameter and preferably no greater than 8 inches (20.32 cm) diameter. Preferably, the tube diameter is nominally 6 inches (15.24 cm). The length of tubes 15 is approximately between 3 feet (0.914 m) and 12 feet (3.66 m). Importantly, the cross-section of the tube cut at any section along its length will be constant. The tube material is not deemed critical to the function of the invention, but from a durability function, any conventional high nickel chromium rolled alloy steel is preferred.

No matter what conventional curve tube configuration is employed, each tube 15 will have at least a first or burner fired entrance end 16 and a second or product exit end 17. Adjacent each tube end 16, 17 is a straight line portion 19 of the tube which in turn terminates in a curve portion 20 of each tube. Importantly, the internal diameter or cross-sectional area of curve portion 20 is constant and equal to that of the straight line portion 29. Each straight line portion 19 of each tube is supported at at least two places, which are designated as S-1 and S-2 in FIG. 1 and tube ends 16, 17 are likewise supported along the furnace wall at S-3 to, in effect, give each straight portion of the tube three supports.

Supports S-1 and S-2 are conventional supports similar to ones used to support fuel fired radiant tubes with the exception that an insulating material is used where tube 15 comes in contact with supports S-1, S-2 and thus supports S-1 and S-2 are not shown or described in further detail herein. Supports S-1, S-2 may be affixed to one of the sidewalls or the supports may in fact assume the shape of a conventional hanger. Alternatively, one of the supports, S-1, may be moved to curvilinear portion 20 of tube 15 and affixed to an end wall.

Figure 3:
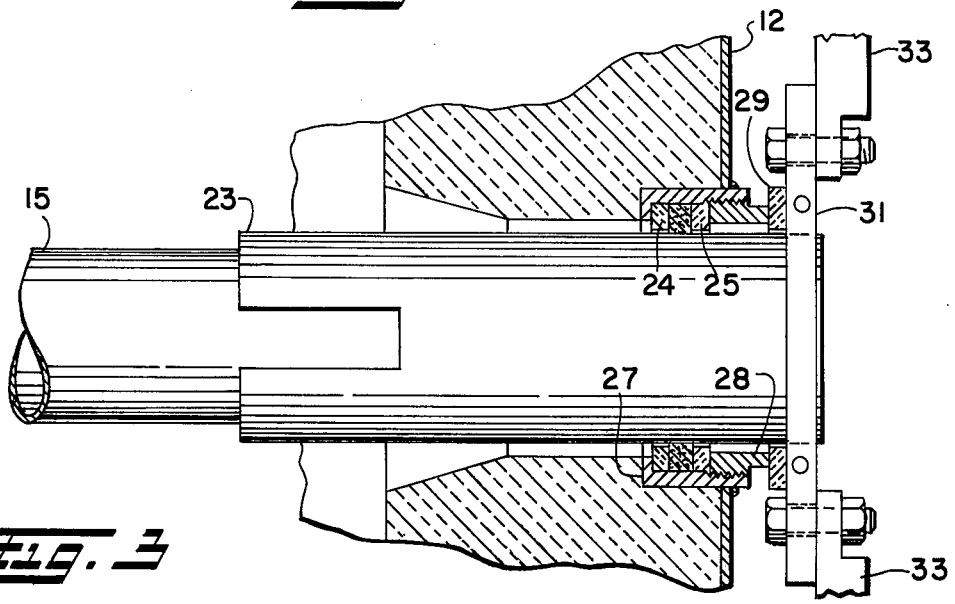
FIG. 3 is an elevation view of a construction detail of the subject invention.

Support S-3 which ties the tube into rear end wall 12 is shown in detail in FIG. 3 and is somewhat typical of conventional supports used in smaller, electrically heated tubes. When the tube arrangement is electrically heated, it is desirable not to heat the ends of the tube which extend through end wall 12. It is also desired to rigidize the tube ends for terminal connections while also providing support for straight line portions 19 of each tube 15. The resistance of the tube is therefore decreased by increasing the effective tube thickness at its end portion by means of a metal tubular sheet 23 which fits over the tube end and extends through the refractory of rear end wall 12. Support S-3 which supports tubular sheet 23 in an electrically insulated manner includes first and second washers 24, 25 which are made of a conventional insulating material and which in turn are received within an internally threaded bushing 27 rigidly secured to rear end wall 12. A specially formed steel nut 28 threadedly engages bushing 27 and adjacent the nut 28 is positioned an insulated third washer 29. Abutting third washer 29 is a copper terminal connector 31 to which a busbar connector 33 is secured. Copper connector 31 comprises two rectangular bars having semicircular areas notched or cut away from one side thereof. The radius of the semicircular area would, of course, be at least equal to or slightly greater than the radius of tubular sheet 23. The rectangular bars are clamped together by fasteners (not shown) to securely embrace tubular sheet 23.

Referring now to FIGS. 1, 2, 3 and 5, the electrical power means is shown to include a series of busbar connectors 33 connecting in series relationship (FIG. 1) the copper connectors 31 of each tube 15 to the terminals of a step down transformers 34, which in turn is connected to a source of alternating current (not shown), preferably a three phase current of 440 volts. Transformer 34 has two sets of terminals, designated as T-1 and T-2 with each terminal set controlling the current into tubes 15 adjacent a sidewall of the furnace. It should be noted that busbars 33 which connect transformer terminals T-1, T-2 to copper connectors 31 are straight line rectangular straps of metal (preferably copper) with the busbar containing the incoming current removed from the busbar containing the current traveling its return path. It should also be noted that the transformer is located as close as possible to tube ends 17, typically a distance of 3 feet 6 inches and preferably no greater than 10 feet. Transformer 34 is equipped with an actuating means in the form of a saturable core reactor (not shown) which permits the current supplied by the transformer to be varied. Alternatively, transformer 34 could be provided with actuating means in the form of a separate saturable core reactor or saturable core reactor could be replaced with a magnetic contactor or a solid state silicone control rectifier, all such devices being common in the art. A thermocouple 36 or temperature sensing means in furnace enclosure 13 senses the temperature of the furnace enclosure and emits a signal to a controller or controller means, shown schematically in FIG. 5 as 38. Controller 38 in turn controls the saturable core reactor of transformer 34 to control the current emitted from the transformer. Current from the transformer travels through busbars 33 to copper connectors 31 and through radiant tubes 15 thereby heating the tubes. During startup of the furnace in the electrical mode, the current draw from transformer 34 will be about 3800 amperes but not less than about 3000 amperes, (at a voltage of 30 volts) for tubes 15 of the dimensional size noted. As the furnace temperature in furnace enclosure 13 increases, controller 38 will function to reduce vis a vis the saturable core reactor the amperage from transformer 34 and eventually the amperage will be reduced to zero when operating furnace temperature is reached.

Figure 2:
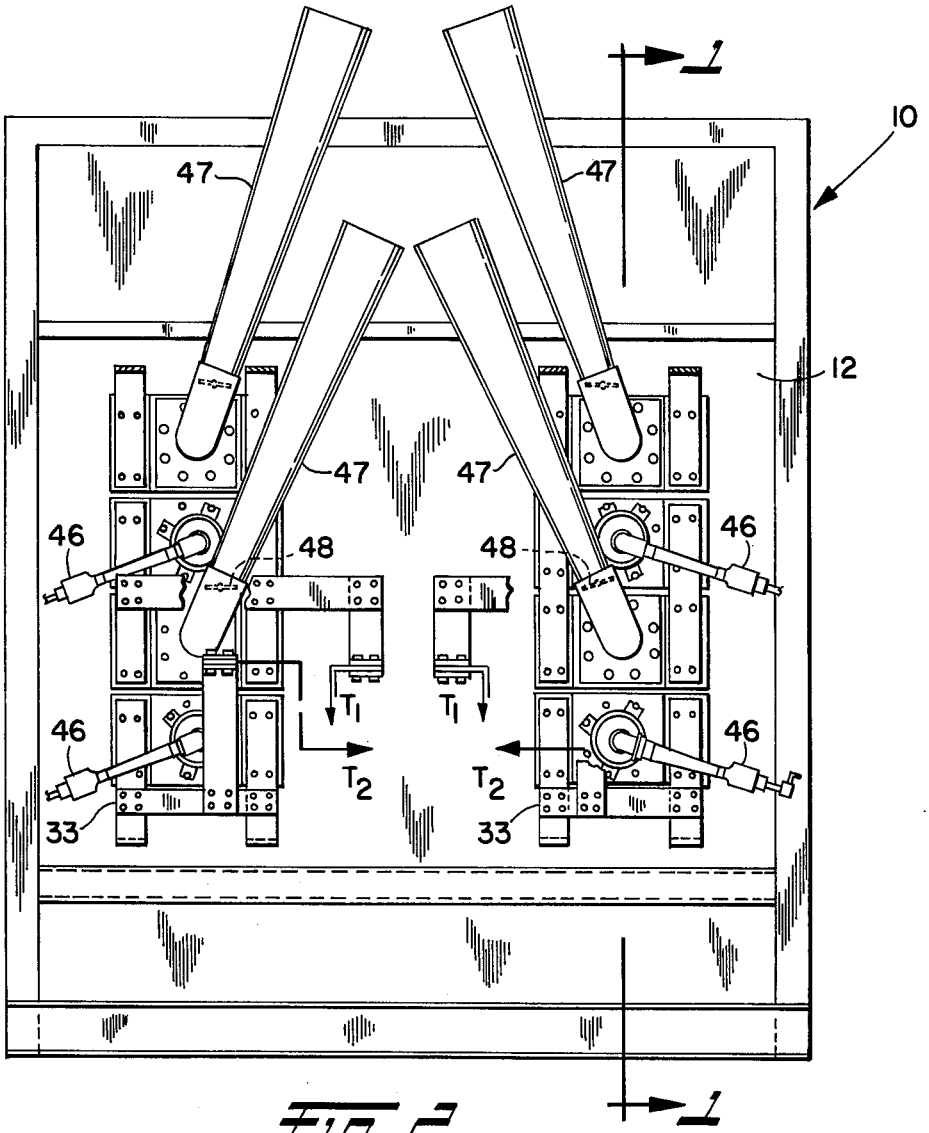
FIG. 2 is an end view of the furnace shown in FIG. 1.
Figure 4:
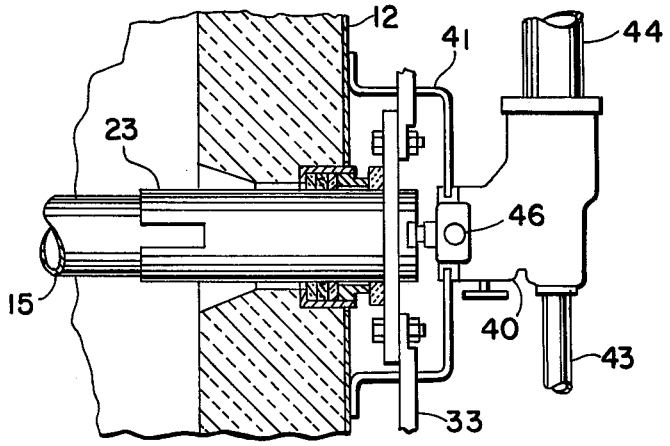
FIG. 4 is an elevation view illustrating the burner mounting employed in the subject invention.

Referring now to FIG. 4, the combustion means of the invention includes a conventional burner 40 of the suction type for each tube 15. The burner is fixedly mounted to rear end wall 12 by brackets 41 so that the burner fires its products of combustion through the burner end 16 of each tube 15. If desired, bracket 41 could be made to swivel so that burner 40 could swivel away from burner end 16 of each tube 15 to permit plugging of the burner end during electrical heating of tube 15. Each burner is provided with a gas line 43 and an air supply line 44. Also each burner is supplied with a conventional flame pilot tube 46 for igniting the burner, as best shown in FIG. 2. Also illustrated in FIG. 2 are exhaust piping or eductors 47 for the burner with each eductor being connected to the discharge end 17 of each tube 15. Eductors 47 in turn are connected to the flue or to a recuperator (not shown) for exhausting in a conventional manner. Within each eductor is a baffle 48 operated by any conventional control (not shown) to an open or closed position Baffles 48 permit the discharge end 17 of each tube 15 to be closed, if desired, during the electrical heating mode.

Figure 5:
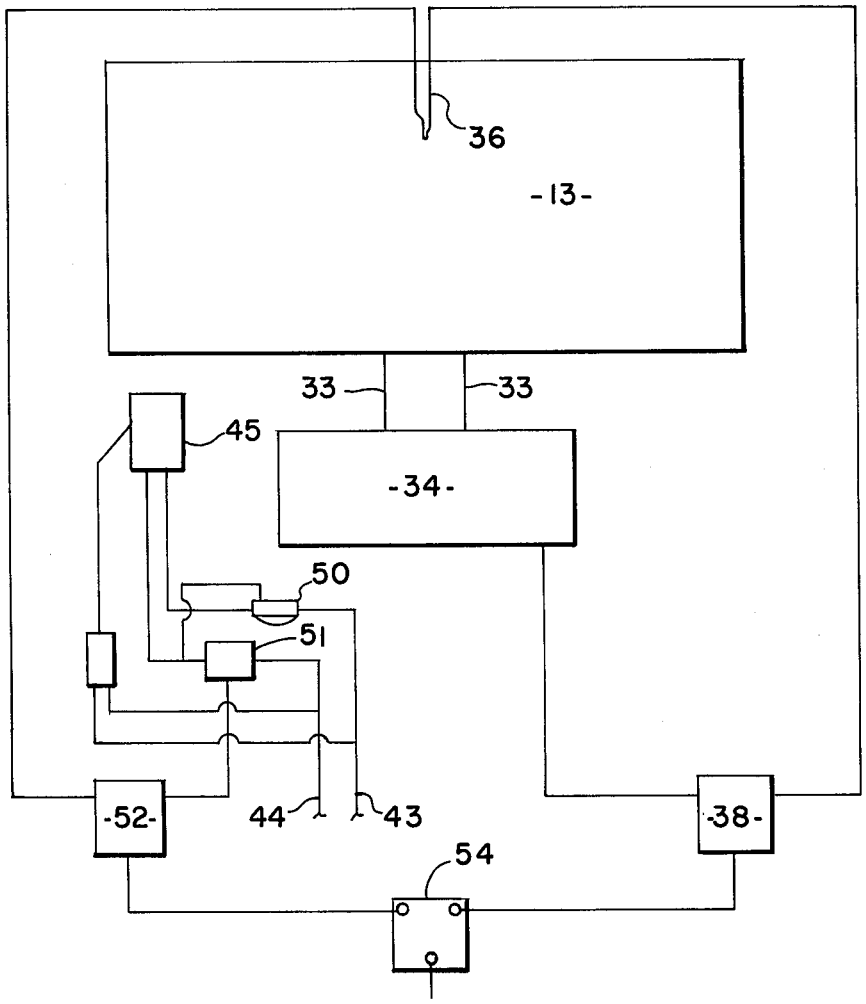
FIG. 5 is a schematic illustration of the controls used in the subject invention.

Referring now to FIG. 5, there is shown a conventional control arrangement for burner 40. This arrangement includes a conventional backpressure regulator or pressure regulator means 50 which controls the flow of gas to the burner in a fixed proportion to the flow of air in air line 44 to the burner thereby insuring proper ratios of fuel and air for efficient combustion. The flow of air in air supply line 44 in turn is controlled by conventional air valve or burner valve means 51 in air supply line 44. Thermocouple 36, or alternatively a second thermocouple in furnace enclosure 13, is connected to a second controller or controller means 52 which in turn controls the opening of valve 51 thereby regulating the air flow, the gas flow through air pressure regulator 50 and thus the intensity of the burner flame in accordance with the furnace temperature sensed by thermocouple 36.

Completing the schematic of FIG. 5 is the switching means of the present invention which includes an interlock switch 54 which permits either the first or second controller 38, 52 respectively to function while the other is rendered inoperative.

In operation, the position of the interlock switch 54 determines whether the tubes are heated by the combustion means or the electrical power means. In this connection, it is sometimes desirable to plug the tube ends when the electrical power means is actuated to prevent air from entering the interior of each tube 15 thus removing heat. For this reason, baffles 48 may be actuated and each burner end 16 of each tube 15 may be plugged by any suitable heat resistant material. By plugging the tube end, the efficiency of the electrical heating arrangement is improved. Alternatively, depending upon the heat treat operation to be conducted on the work within furnace enclosure 13, the tube ends may be open, when the electrical power means is actuated, as for example if the work is being carburized within the furnace. This is necessary, as known in the art, to provide a sufficient carburizing potential between each tube 15 and the furnace atmosphere to prevent tube deterioration.

As thus described, several aspects of the invention should be noted. For example, it was known that certain tube configurations could be made of certain sizes and could be utilized to heat a furnace by the hot products of combustion issuing from burners placed at the entrance of the tube. Furthermore, it has also been known that certain of these tubes could be made of relatively thin wall thickness (as thin as 0.125 inch or 3.175 mm) and exhibit a satisfactory service life. It was also known that relatively small diameter tube length could be heated by passing electrical current therethrough. However, experience gained in designing, manufacturing and servicing such prior art heating elements heretofore led the inventor and others to discount electrifying, fuel-fired tubes for a number of reasons. First, calculations showed that an excessively high current would be required to electrify a fuel fired tube. This resulted in reducing the thinness of the tube to minimize the current draw as much as possible. However, this would result in a weakening of the tube and when the tube was heated in a fuel fired mode, there would be a tendency to reduce the wall thickness of the tube as a result of high velocity burner gases traveling through the tube. If the tube wall thickness is reduced in certain areas or spots on the tube, when the tube is electrically heated, especially at the high current draw defined herein, hot spots or localized heating over the reduced wall thickness would occur. It is felt that a reduction in the thickness of the tube of several thousandths of an inch would promote such hot spots. The existence of hot spots leads to a short tube life and furthermore can cause distortion of the tube which then adversely affects the tube heating during gas firing. To maintain the efficiency of the tube during the gas firing mode, the placement of three supports over the straight length portion of the tube is required. This distortion aspect of the invention is believed especially critical when two or more tube arrangements are used such as shown in FIG. 1 since the placement and position of the legs of each tube relative to one another is viewed as being critical to the heat transfer imparted to the work during operation of the furnace. A second condideration against electrifying radiant tubes was the inductive current losses necessarily resulting from the arrangement. Such losses could have required a much higher current than that theoretically calculated to heat the tubes, thus making such an arrangement impossible of being electrically heated from a practical sense. Furthermore, past experience gained with small tubes which have been electrically heated was not applicable due to the differently shaped fuel fired tubes. It was determined after testing that the fuel fired tube configuration did, however, not result, in and of themselves, in establishing significant inductive currents impeding the heating of the tubes. However, the busbar connectors from transformers 34 to tube ends 16, 17 had to be as short as possible in straight line segments (as opposed to curved segments) with the connections from T-1 and T-2 removed from one another as far as possible without circumscribing tubes 15. Finally, the connectors 31 had to be of the solid metal type to avoid significant corrosion since connectors 31 are somewhat exposed to the burner flame.

The invention has been described with reference to a preferred embodiment, and it is apparent that modifications and alternations will occur to others upon the reading and understanding of the specification. It is my intention to include all such modifications and alterations insofar as they come within the scope of the present invention.

It is thus the essence of the invention to provide a heating arrangement which can be switched from one mode to the other mode with little effort.

Having thus described the invention, I claim:

1. Heating apparatus for a furnace enclosure comprising:

a thin-walled, open-ended tube extending into and out of said enclosure;

electrical power means attached to said ends of said tube for heating said enclosure by initially passing a high amperage current of about 3800 amperes but not less than about 3000 amperes through said tube;

combustion means attached to an end of said tube for heating said enclosure by passing hot gases through said tube; and switching means for actuating said electrical power means while deactivating said combustion means without removing said combustion means from said tube and actuating said combustion means while deactivating said electrical power means without removing said electrical power means from said tube.

2. Apparatus of claim 1 wherein said thin-walled tube has a typical wall thickness of about 0.120 inch and no greater than 0.125 inch and a diameter between 4 inches and 8 inches.

3. Apparatus of claim 2 wherein the cross-section through said tube is constant throughout said tube's length.

4. Apparatus of claim 4 wherein:

said furnace enclosure is defined by a roof, a floor, and a plurality of walls, said tube having at least an entrance end and an exit end with both ends extending through and supported by the same furnace wall, a straight line tube portion adjacent each tube end and a curved tube portion adjacent each straight line tube portion, and at least two supports for each straight line tube portion.

5. Apparatus of claim 4 wherein a plurality of tubes are provided in said wall, said electrical power means connecting said tubes in series relationship.

6. Heating apparatus of claim 4 wherein said electrical power means includes:

a source of alternating current, a step down transformer connected to said source and in close proximity to said tube, a bus connector comprising substantially straight line segments extending from a first terminal of said transformer to one end of said tube and extending from the opposite end of said tube to a second terminal of said transformer, temperature sensing means in said enclosure for sensing the temperature thereof, transformer actuating means for actuating said temperature sensing means for controlling the output of said transformer, and controller means for actuating said transformer actuating means in accordance with said temperature sensing means.

7. Heating apparatus of claim 6 wherein said combustion means includes a burner mounted in an isolated manner in one end of said tube, a flue in fluid communication with the opposite end of said tube, a fuel line and an air line to said burner, and pressure regulator means between said air line and said fuel line for controlling fuel flow in accordance with air pressure flow, burner valve means controlling the air flow in said air line, second controller means for controlling said burner valve means in accordance with said temperature sensing means.

8. Heating apparatus of claim 7 wherein said switching means includes an interlock means for actuating either said electrical power means or said combustion means.

* * * * *